United States Patent [19]

Li

[11] Patent Number: 4,913,436

[45] Date of Patent: Apr. 3, 1990

[54] PUZZLES AND GAME BASED ON GEOMETRIC SHAPES

[76] Inventor: Shuo-Yen R. Li, 820 Long Hill Rd., Gillette, N.J. 07933

[21] Appl. No.: 276,290

[22] Filed: Nov. 25, 1988

[51] Int. Cl.[4] ..... A63F 9/10

[52] U.S. Cl. ..... 273/157 R

[58] Field of Search ..... 273/157 R

[56] References Cited

U.S. PATENT DOCUMENTS

| | | | |
|---|---|---|---|
| 232,140 | 9/1880 | Mason | 273/157 R |
| 3,637,217 | 1/1972 | Kent | 273/157 R |
| 3,672,681 | 6/1972 | Wolf | 273/157 R |
| 4,561,097 | 12/1985 | Siegel | 273/157 R |

FOREIGN PATENT DOCUMENTS

| | | | |
|---|---|---|---|
| 10776 | of 1891 | United Kingdom | 273/157 R |

*Primary Examiner*—Anton O. Oechsle

*Attorney, Agent, or Firm*—Peter L. Michaelson

[57] ABSTRACT

Planar puzzles and a game utilizing these puzzles exploit simple geometric shapes for the design of a plurality of initial configurations that make up each of the puzzles. Each of the initial configurations may be further subdivided into elementary pieceparts. For each puzzle, it is possible to rearrange certain of the initial configurations to form a new puzzle configuration having the identical shape of the initial configurations by reassembling the pieceparts of each of the configurations. By proceeding in a series of merger steps, it is possible to rearrange all of the initial configurations into a single merged configuration that also has the same shape as the original configurations. The game aspect furnishes each player with the opportunity to generate mergers from configurations under control of the other players. The strategy is to generate as many mergers as possible in the time allowed while blocking other players from merger opportunities.

11 Claims, ~~12~~ 9 Drawing Sheets

FIG. 4
| |
|---|
| FIG. 4A |
| FIG. 4B |
| FIG. 4C |
FIG. 4A
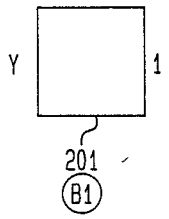
FIG. 4B
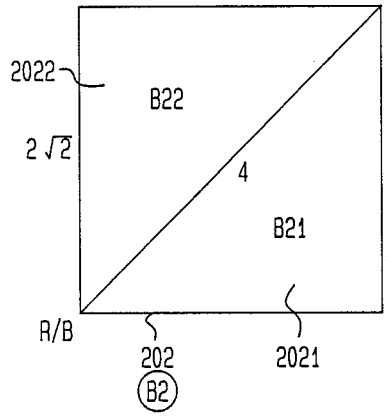
FIG. 4C
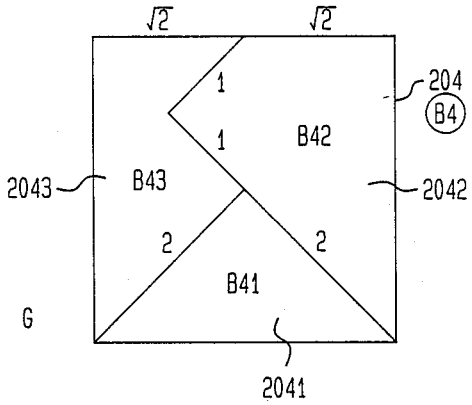

FIG. 6
| |
|---|
| FIG. 6A |
| FIG. 6B |
FIG. 6A
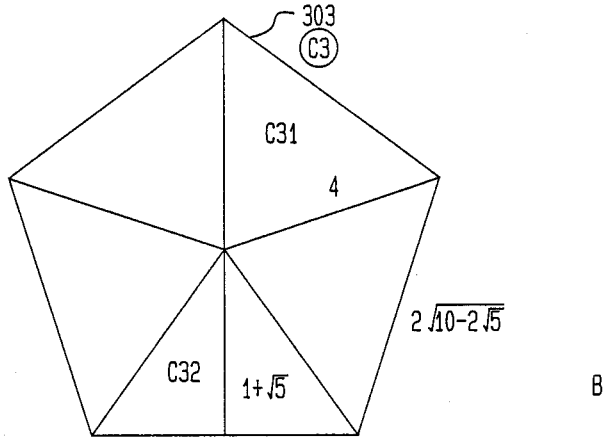
FIG. 6B
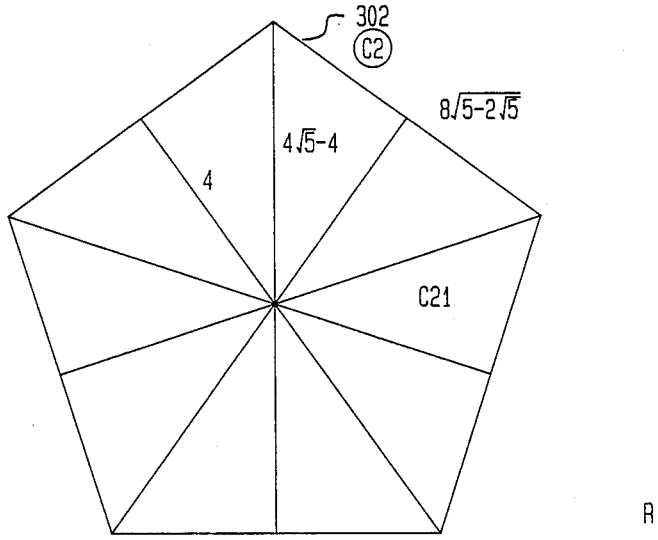

FIG. 7
| |
|---|
| FIG. 7A |
| FIG. 7B |
FIG. 7A
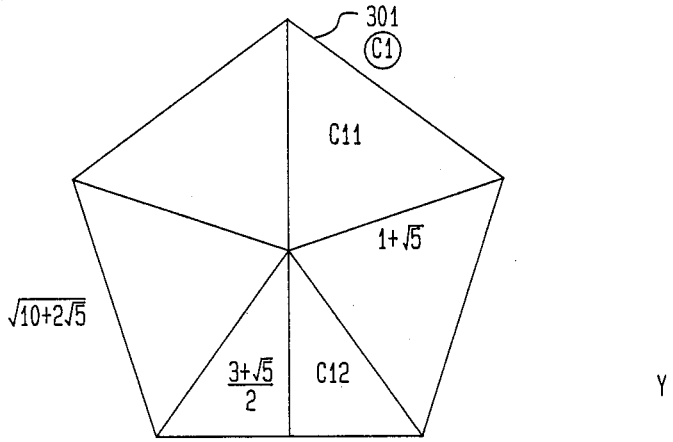
FIG. 7B
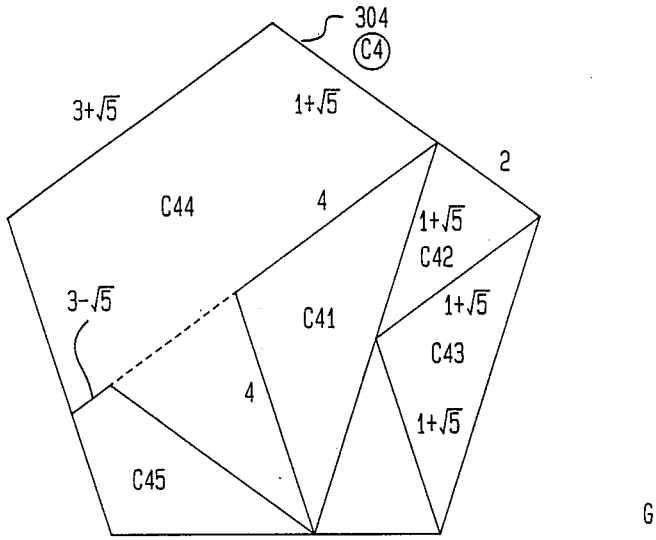

FIG. 9
| FIG. 9A | FIG. 9B |
|---|---|
FIG. 9A
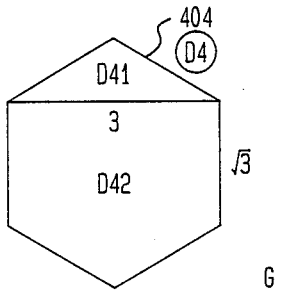
FIG. 9B
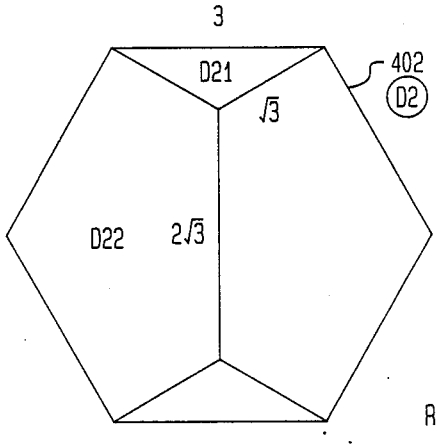
FIG. 10
| FIG. 10A | FIG. 10B |
|---|---|
FIG. 10A
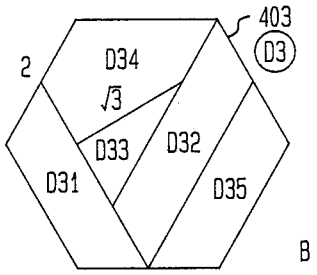
FIG. 10B
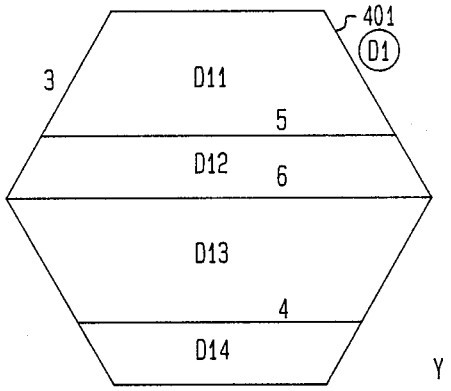

FIG. 12
| FIG. 12A | FIG. 12B |
|---|---|
FIG. 12A
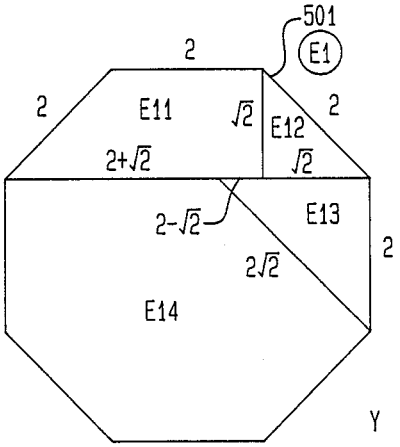
FIG. 12B
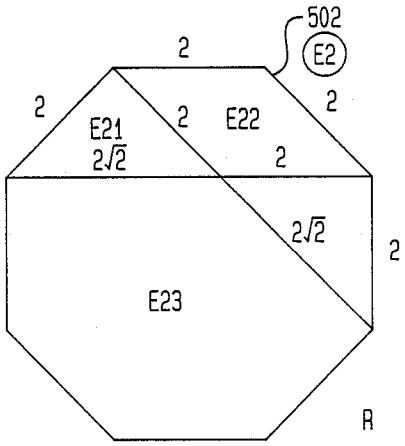
FIG. 13
| FIG. 13A | FIG. 13B |
|---|---|
FIG. 13A
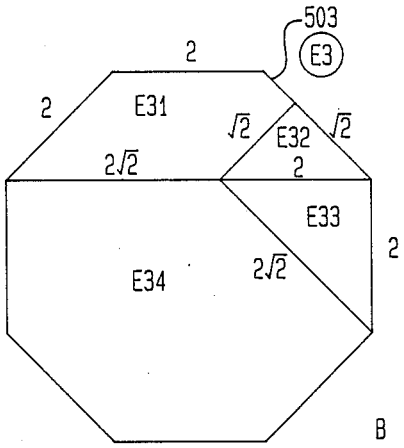
FIG. 13B
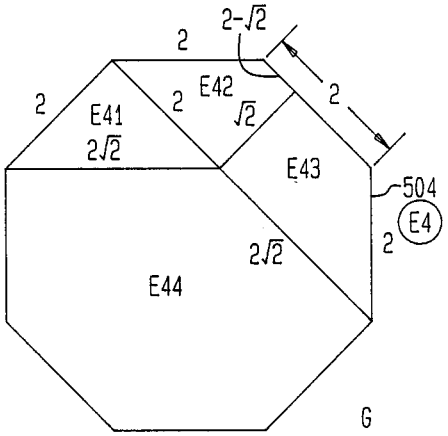

PUZZLES AND GAME BASED ON GEOMETRIC SHAPES

FIELD OF THE INVENTION

This invention relates generally to games and puzzles and, more specifically, to both puzzles and a game utilizing the puzzles having a theoretical basis founded in the mathematical theory of geometric shapes.

BACKGROUND OF THE INVENTION

Various forms of puzzles and puzzle-like toys are presently available in the art that challenge one's skill in manipulating puzzle pieceparts to arrive at a completed puzzle. The pieceparts of conventional planar puzzles, that is, puzzles that are basically two-dimensional or are assembled on a flat surface, are generally randomly shaped with notches and complementary protuberances being utilized to fit the pieceparts together. Some puzzles do have pieceparts that have somewhat regular geometric shapes and these pieceparts are placed proximate to one another to complete the puzzle. Oftentimes a frame is used to hold the pieceparts in juxtaposed relationship.

The majority of conventional planar puzzles merely rely on the ability of the player to visualize the location and placement of the numerous pieceparts, most of which have a color scheme or color variations to aid in the visualization. To the best of my knowledge, there presently do not exist planar-type puzzles that have a theoretical foundation based on advanced geometry, especially those that challenge a player to perform a simply-stated but counter-intuitive act of grouping together pieceparts. Such puzzles would add a degree of sophistication to the puzzle solution process in that, besides visualization skills, one could analyze the required arrangement of pieceparts using mathematical reasoning and insight, thereby honing the player's appreciation of shapes, intuition in geometry, and interest in objects of a generally mathematical nature.

Puzzles are usually worked by one person and games typically pit the skills of two or more players against one another. It is rare in the art to utilize the same puzzles worked on by an individual player as the basic building blocks in a game played by a plurality of players. Again, to the best of my knowledge, it is not known in the art to combine a plurality of puzzles based on advanced geometry into a single game.

SUMMARY OF THE INVENTION

These shortcomings and limitations are obviated, in accordance with the present invention, by imbuing planar puzzles with notions about geometric shapes and then creating a game by exploiting characteristics of these geometric puzzles.

Broadly speaking, each puzzle comprises a plurality of initial configurations of identical geometric shape, but not necessarily of the same size. Each configuration may be composed of numerous pieceparts. A puzzle is solved in a series of steps. As a first step, a rearrangement of two of the initial configurations is accomplished by merging them into a merged configuration that has the same shape as the original configurations. Of necessity, the area of the merged configuration is equal to the combined areas of the two configurations comprising the merged configuration. As a next step, two of the configurations existing at the end of the first step, including any remaining initial configurations and the merged configuration are selected for a merger, thereby creating a second merged configuration having the same shape as the original configurations. Each succeeding step proceeds in a similar manner in that two of the existing configurations are reassembled into a merged configuration of the same shape. At the end, a single merged configuration is created which has the same shape as the original configurations and which is composed of all the original configurations.

The game aspect of the invention utilizes a plurality of puzzles. Each of the puzzles is composed of numerous initial configurations each having a distinct shape, such as triangles, squares, pentagons, hexagons and octagons. Also, each of the configurations in a puzzle has an identifier, such as color, to distinguish each configuration one from the other. The game is played according to a series of steps. Initially, each player selects, and thereby controls, all the configurations with a given identifier. The game is then divided into successive rounds of mergers. Each round is played with a predetermined order of play. For each round, the following series of substeps occur: (i) in correspondence to the order of play, each player selects a pair of configurations determined by those configurations under control of the player; (ii) a merger activity is initiated by each player and continues for a specified period; and (iii) at the end of the period a score is compiled for each player completing a total merger. If any merger attempt is unsuccessful, the configurations are returned to the players controlling the configurations prior to the merger attempt. The game ends when no player makes a successful merger for a given number of rounds.

The organization and operation of this invention will be better understood from a consideration of the detailed description of the illustrative embodiments thereof, which follow, when taken in conjunction with the accompanying drawing.

BRIEF DESCRIPTION OF THE DRAWING

FIG. 4 comprising FIGS. 4A, 4B, and 4C illustrates three of the four building block configurations for the square puzzle;

FIG. 6 comprising FIGS. 6A and 6B illustrates two of the four building block configurations for the pentagonal puzzle;

FIG. 7 comprising FIGS. 7A and 7B illustrates the two remaining building block configurations for the pentagonal puzzle;

FIG. 9 comprising FIGS. 9A and 9B illustrates two of the four building block configurations for the hexagonal puzzle;

FIG. 10 comprising FIGS. 10A and 10B illustrates the two remaining building block configurations for the hexagonal puzzle;

FIG. 12 comprising FIGS. 12A and 12B illustrates two of the four building block configurations for the octagonal puzzle;

FIG. 13 comprising FIGS. 13A and 13B illustrates the two remaining building block configurations for the octagonal puzzle.

DETAILED DESCRIPTION

To elucidate the principles of both the puzzle and game aspects of the present invention, it is necessary to describe the composition and then the solution methodology of each of the five different types of puzzles separately. Once described individually, then the manner by which the five puzzle types are collectively combined into the game aspect of the instant invention may be readily presented.

(1) Triangle Puzzle

Figure 1:
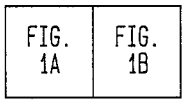
FIG. 1 comprising
Figure 1A:
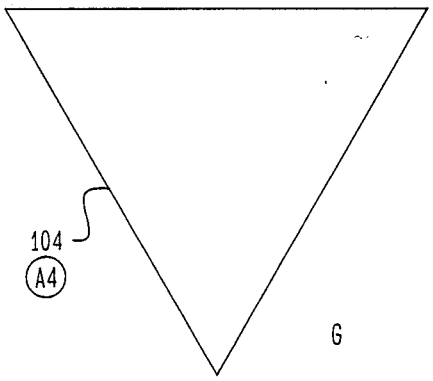
FIGS. 1A and 1B illustrates two of the four building block configurations for the triangle puzzle.
Figure 1B:
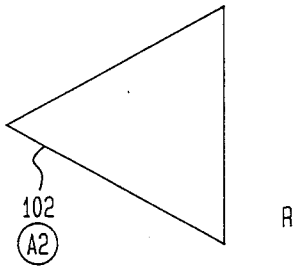
Figure 2:
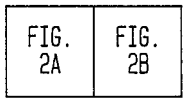
FIG. 2 comprising
Figure 2A:
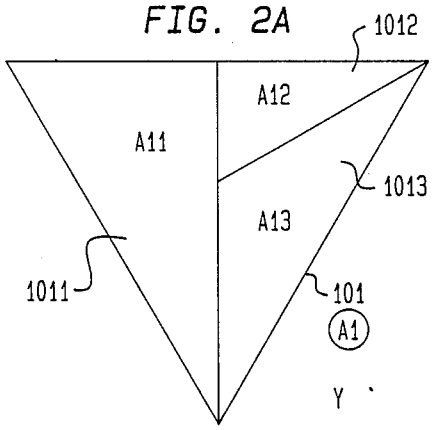
FIGS. 2A and 2B illustrates the two remaining building block configurations for the triangle puzzle.
Figure 2B:
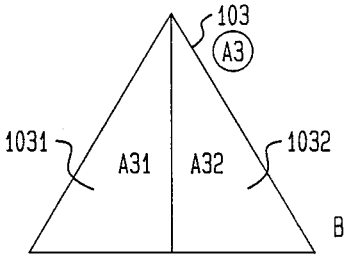

With reference to FIGS. 1 and 2, the building block components for the triangle puzzle are shown as being composed of four different triangular configurations, namely, elements 102 and 104 of FIG. 1 and elements 101 and 103 of FIG. 2 overlaid on a reference grid of unit length. (Note that elements 101–104 have also been identified by supplementary or alias indicia A1–A4, respectively; these alias names facilitate description of the game aspect of the invention). Element 101 is an equilateral triangle having sides of normalized length of 6 units. It is divided into three pieces, namely, component parts 1011, 1012 and 1013. Piecepart 1011 is a right triangle formed from a bisection of one of the vertex angles of triangle 101 with a perpendicular to the side opposite the bisected angle. Triangle 1011 has sides of normalized lengths 3, $3\sqrt{3}$ and 6 units. A second piecepart is formed from the remaining half of triangle 101 by bisecting the 60 degree vertex angle to carve out right triangle 1012 having sides of normalized lengths of $\sqrt{3}$, 3 and $2\sqrt{3}$ units. Piecepart 1013 is an isosceles triangle having sides of normalized lengths of $2\sqrt{3}$, $2\sqrt{3}$ and 6 units.

Element 103 is another equilateral triangle having sides of normalized length of $2\sqrt{3}$ units.

Element 102 is another equilateral triangle having sides of normalized length of 4 units. It is further divided into two pieces, namely, component parts 1031 and 1032. As depicted, pieces 1031 and 1032 are identical right triangles formed from a bisection of one of the vertex angles of triangle 103 with a perpendicular to the side opposite the bisected angle. Consequently, each triangle 1031 or 1032 has sides of normalized length 2, $2\sqrt{3}$ and 4 units.

Finally, element 104 is yet another equilateral triangle having sides of normalized length of 6 units. (Note that each piece of partitioned triangles 101 and 103 have alias names also; e.g., element 1031 is also designated A31 whereas element 1013 is labeled A13).

The puzzle aspect of this invention utilizes building block components 101–104 in the following manner. A merger is defined as the reassembling of the pieceparts from two triangular configurations into a single, merged triangular configuration. The puzzle is solved by making three successive mergers. As a first step, two of the triangles 101–104 are chosen for a merger; if there is a successful merger, then there exist three triangles, namely, two original configurations and one merged configuration at the end of step 1. As a second step, two of the three triangles existing after step 1 are chosen for a merger; again, if there is a successful merger, two triangular configurations will exist. As a final step, the triangles resulting from step 2 are merged.

Figure 3:
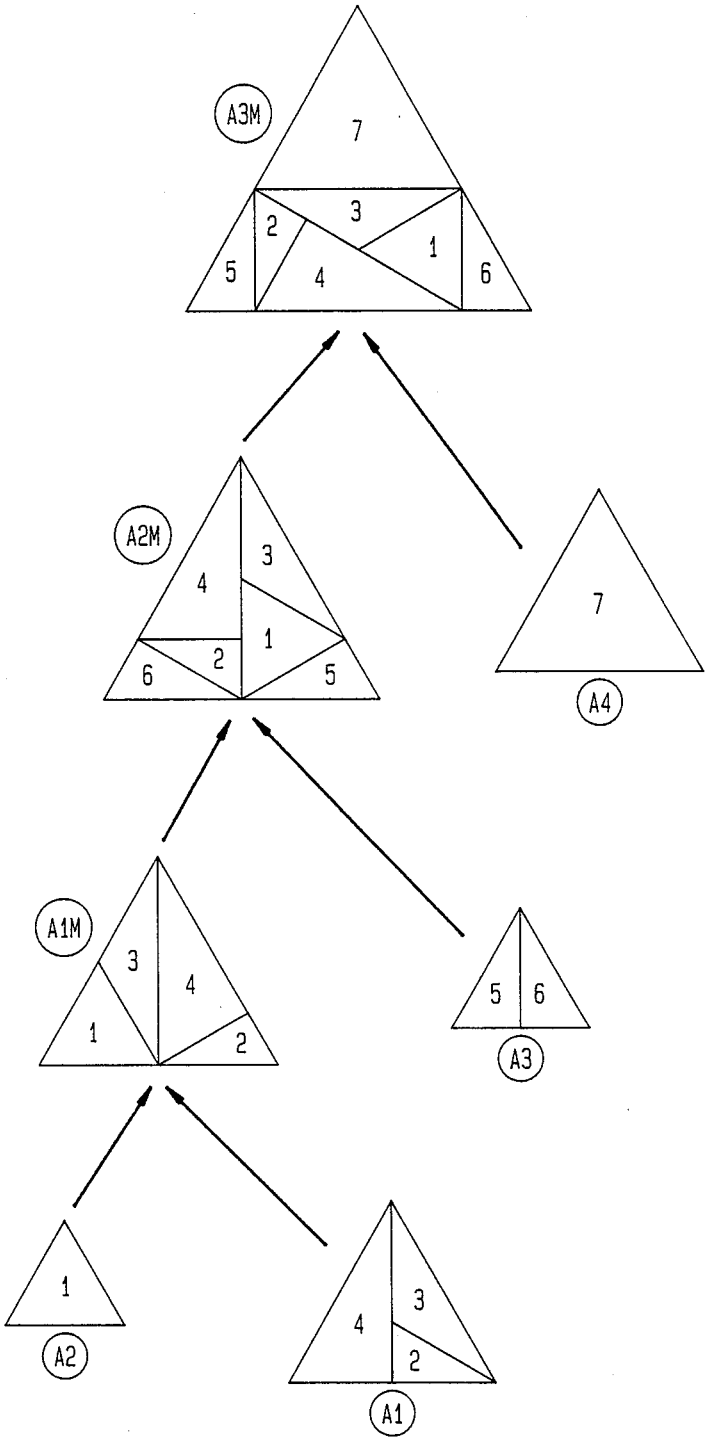
FIG. 3 depicts the assembly sequence to solve the triangle puzzle.

As an aid to understanding this reassembly process, FIG. 3 depicts one manner of making three successive mergers. In the first step, elements A1 and A2 are merged into an equilateral triangle, designated A1M, having sides of normalized length of $4\sqrt{3}$ units. After the first step, triangles A3, A4 and A1M exist. In the second step, triangle A3 is merged with equilateral triangle A1M to form equilateral triangle A2M having sides of normalized length of 8 units. In the final step, triangle A2M and A1 are merged or arranged into equilateral triangle A3M having sides of normalized length of 10 units.

It is to be understood that this merger sequence is the only solution to the puzzle. An example of an unsuccessful attempt at a merger would be to select at the first step original configurations A2 and A3. There is no feasible way to combine A2 and A3 into another triangle.

Knowledge of geometry facilitates solving the puzzle. For instance, it is a great advantage to realize that the area of an equilateral triangle—either an original or merged configuration—is proportional to the square of the length of a side, i.e., Area$\sim$(side length)$^2$. Thus, a successful three-step merger results in $$\text{Area(A3M)} \sim (2\sqrt{3})^2 + 6^{2+42} + 6^2 = 100 = (10)^2,$$

so each side of A3M is of length 10 units. Similarly, $$\text{Area(A2M)} \sim (2\sqrt{3})^2 + 6^2 + 4^2 = 64 = (8)^2, \text{ and}$$

$$\text{Area(A1M)} \sim (2\sqrt{3})^2 + 6^2 = 48 = (4\sqrt{3})^2.$$

As a final point, it should be noted that the triangles 101–104 may be color coded to aid in grouping pieceparts. As an example, elements 101–104 may be yellow, red, black and green, respectively. The importance of the color coding scheme will be apparent when the triangle puzzle is used in conjunction with other puzzles for the game aspect of the invention as discussed shortly.

(2) Square PUzzle

With reference to FIG. 4, three of the four building block components for the square puzzle are shown as being composed of three different square configurations, namely, elements 201, 202 and 204. The fourth building block component, designated as element 203 but not shown in FIG. 2, is identical in shape and dimensionality to element 202; the only difference is the color coding or other distinct identifier. Thus, for example, element 202 may be red whereas element 203 may be black. (Note again that elements 201, 202 and 204 have alias indicia of B1, B2 and B4, respectively; similarly, element 203 has a corresponding indicium of B3). Element 201 is a square having sides of normalized unit length.

Element 202 (similarly for element 203) is a square having sides of normalized length of $2\sqrt{2}$ units. It is further divided into two pieces, namely, component parts 2021 and 2022. As depicted, pieces 2021 and 2022 are identical right isosceles triangles formed by dividing the square along a diagonal. The hypotenuse of the triangle is 4 normalized units.

Element 204 is a square having sides of normalized length of $2\sqrt{2}$ units. It is divided into three pieces, namely, component parts 2041, 2042 and 2043. Piecepart 2041 is an isosceles triangle having sides of normalized lengths of 2, 2 and $2\sqrt{2}$. Piecepart 2042 has four sides of normalized lengths of 1, $\sqrt{2}$, $2\sqrt{2}$ and 3, with an interior angle of 90 degrees between the sides of lengths of 1 and 3, an interior angle of 135 degrees between the sides of lengths 1 and $\sqrt{2}$, an interior angle of 90 degrees between the sides of lengths $\sqrt{2}$ and $2\sqrt{2}$, and an interior angle of 45 degrees between the sides of lengths $2\sqrt{2}$ and 3, respectively. Element 2043, being the remainder of element 204, has five sides of normalized lengths of 4, $\sqrt{2}$, 1, 1 and 2 units. (Note that each part of partitioned squares 202–204 have alias names also; e.g. element 2041 is designated B41 whereas element 2043 is designated B43).

Again, the puzzle aspect of this invention utilizes the building block configurations 201–204 by merging pairs of configurations into a merged configuration. The square puzzle is also solved by making three successive mergers in a manner substantially the same as described above with respect to the merger solution for the triangle puzzle.

Figure 5:
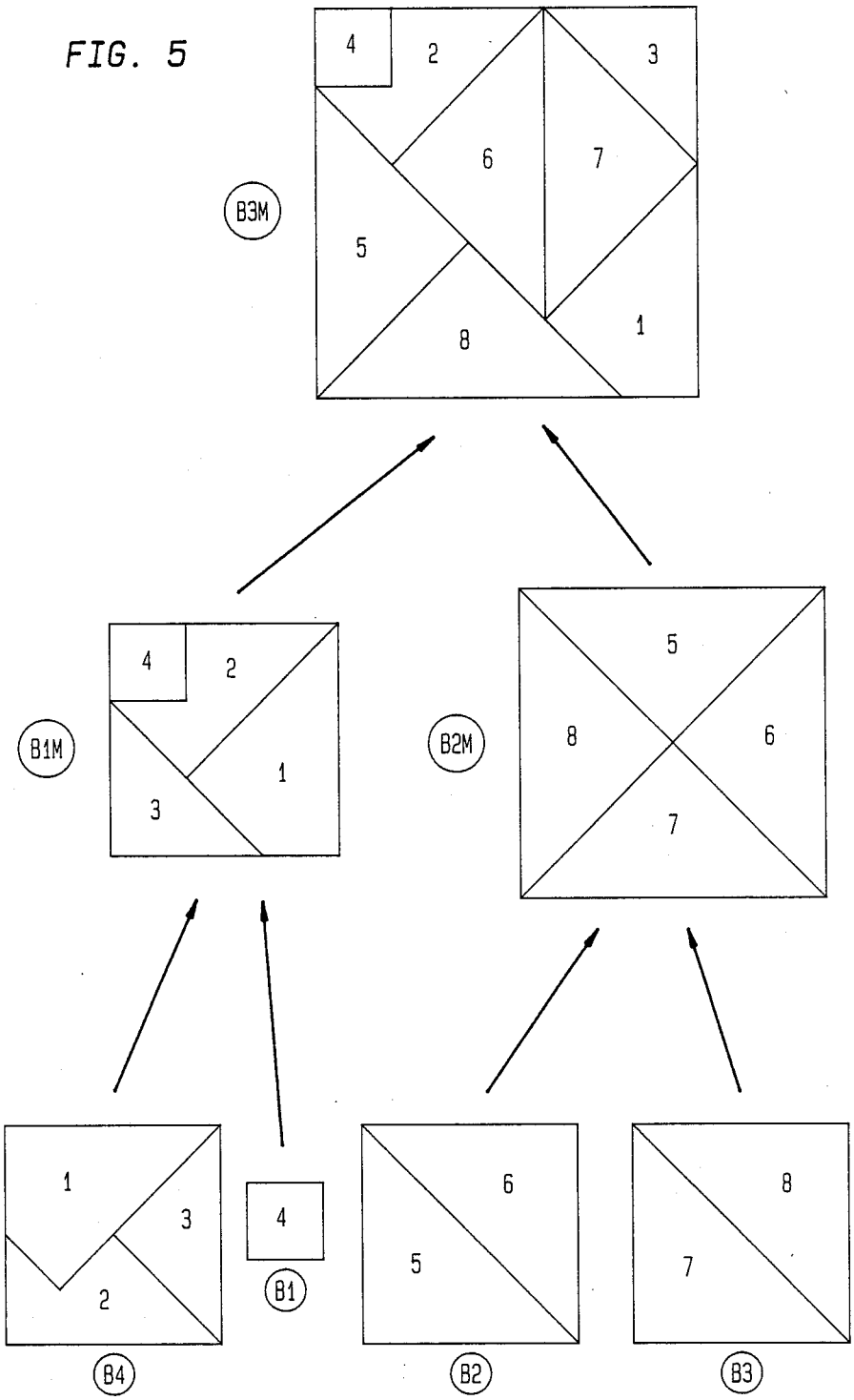
FIG. 5 depicts the assembly sequence to solve the square puzzle.

Again, as an aid to understanding the merging process, FIG. 5 depicts one manner of making three successive mergers. In the first step, elements B1 and B4 are merged into a square designated B1M. In the second step, elements B2 and B2 are merged into a square designated B2M. Finally, both B1M and B2M are merged into a square designated B3M. This merging process is different than the triangle merging process in that all original configurations are merged by the end of the second merger, and only merged squares exist for merger during the third step.

To show how the solution may be understood from a purely mathematical viewpoint, a successful three-step merger results in $$\text{Area(B3M)} \sim (1)^2+(2\sqrt{2})^2+(2\sqrt{2})^2+(2\sqrt{2})^2=25-=(5)^2,$$

so each side of B3M is of length of 5 units. Similarly, $$\text{Area(B1M)} \sim (1)^2+(2\sqrt{2})^2=9=(3)^2, \text{ and}$$

$$\text{Area(B2M)} \sim (2\sqrt{2})^2+(2\sqrt{2})^2=16=(4)^2,$$

so B2M has sides of length 4 and B1M has sides of length 3 units.

Finally, to prepare for the description of the game aspect of the invention, elements 201–204 are yellow, red, black and green, respectively.

(3) Pentagon Puzzle

With reference to FIG. 6, two of the four building block components 302 and 303 for the pentagonal puzzle are depicted. Similarly, FIG. 7 shows the remaining building block components for the pentagonal puzzle, namely, elements 301 and 304. Element 301 is a pentagon having a normalized side length of $(10+2\sqrt{5})^{0.5}$. It is divided into 6 pieces in the following fashion. Four of the pieces are identical isosceles triangles having a side of the pentagon as one leg of each triangle and having equal legs of length $1+\sqrt{5}$; component C11 is representative of these four pieces. The remaining two pieces are identical right triangles formed by dividing a piece like C11 in half such that the hypotenuse of each right triangle is of length $1+\sqrt{5}$ and the legs are of length $0.5(3+\sqrt{5})$ and $0.5(10+2\sqrt{5})^{0.5}$, respectively; component C12 is representative of each right triangle.

Element 302 is a pentagon having a normalized side length of $8(5-2\sqrt{5})^{0.5}$. It is divided into ten identical right triangles each having a hypotenuse of length of $4\sqrt{5}-4$ and legs of length 4 and $4(5-2\sqrt{5})^{0.5}$, respectively; component C21 is representative of each right triangle.

Element 303 is a pentagon having sides of normalized length of $2(10-2\sqrt{5})^{0.5}$. It is divided into 6 pieces in the following manner. Four of the pieces are identical isosceles triangles having a side of the pentagon as one leg of each triangle and having equal legs of length of 4 units; component C31 is representative of these four pieces. The remaining two pieces are identical right triangles formed by dividing a piece like C31 in half such that the hypotenuse of each right triangle is of length 4 and the legs are of length $1+\sqrt{5}$ and $(10-2\sqrt{5})^{0.5}$, respectively; component C32 is representative of each right triangle.

Finally, component 304 is the fourth pentagonal configuration having sides of normalized length of $3+\sqrt{5}$. It is divided up in the following way. Component C41 is an isosceles triangle having sides of length 4, 4 and $2(1+\sqrt{5})$. There are two identical components, of which C42 is representative, that are isosceles triangles having side lengths of $1+\sqrt{5}$, $1+\sqrt{5}$ and 2. Then there is component C43, which is an isosceles triangle having one of the sides of the pentagon as a leg. The other two legs are of length $1+\sqrt{5}$. Component C44 is a non-symmetric, seven-sided piece that may be described as follows: the side lengths and the vertex angles in the clockwise sequential order are $3+\sqrt{5}$, 108 degrees, $1+\sqrt{5}$, 72 degrees, 4, 252 degrees, 4, 36 degrees, 4, 252 degrees, $3-\sqrt{5}$, 72 degrees, $1+\sqrt{5}$, and 108 degrees. (In the sequel, especially the claims, a vector-like notation may be employed for a short-hand in describing the make-up of the various pieceparts. Using this notation, C44 may be described by $<3+\sqrt{5}, 108, 1+\sqrt{5}, 72, 4, 252, 4, 36, 4, 252, 3-\sqrt{5}, 72, 1+\sqrt{5}, 108>$.) Finally, C45 is the remainder of original configuration C4. It has four sides and may also be described in the clockwise manner:

$$\text{C45}=<4, 36, 1+\sqrt{5}, 108, 2, 108, 3-\sqrt{5}, 105>.$$

The color scheme adopted for the pentagonal puzzle is yellow, red, black and green for configurations 301–304, respectively.

Figure 8:
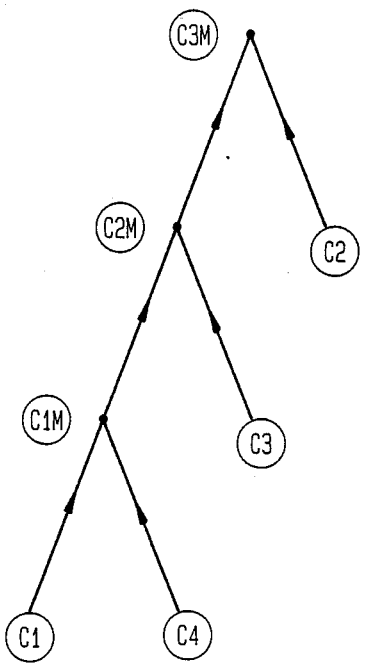
FIG. 8 depicts the manner in which the configurations from the pentagonal puzzle may be arranged to solve the puzzle.

Again, the puzzle aspect of this invention utilizes the configurations 301–304 by merging pairs of configurations into merged configurations. The pentagon puzzle is solved by making three successive mergers in a manner substantially the same as described above with respect to the merger solution for the triangle puzzle. The merger diagram of FIG. 8 alludes to the solution procedure. The first merged pentagonal configuration C1M is made up of configurations C1 and C4. The second merged pentagonal configuration C2M is composed of configuration C3 and C1M. Finally, the third merged configuration C3M is obtained from configurations C2 and C2M.

(4) Hexagon Puzzle

With reference to FIG. 9, two of the four building block configurations 402 and 404 for the hexagonal puzzle are depicted. Similarly, FIG. 10 shows the other two configurations, namely, configurations 401 and 403. Configuration 401 has side length of 3 units and is composed of four dissimilar pieceparts D11–D14. Each component has four sides that may be described in sequential clockwise order. For instance, D11 has the following description:

$$D11=<3, 120, 2, 60, 5, 60, 2, 120>.$$

Similarly:

$$D12=<5, 120, 1, 60, 6, 60, 1, 120>;$$

$$D13=<6, 60, 2, 120, 4, 120, 2, 60>; \text{ and}$$

$$D14=<4, 60, 1, 120, 3, 120, 1, 60>.$$

Configuration 402 has side length of 3 units and is divided into two pairs of identical pieces. Component D21 represents one of these pairs; it is anisosceles triangle having sides of length $\sqrt{3}$, $\sqrt{3}$ and 3. Component D22, which is representative of the second pair, has five sides described in the length-angle fashion: $D22=<\sqrt{3}, 120, 2\sqrt{3}, 120, \sqrt{3}, 90, 3, 120, 3, 90>$.

Configuration 403 has side lengths of 2 units. It is divided intofive separate pieceparts D31–D35. The pieceparts are described as follows:

$$D31=<1, 60, 3, 60, 120, 2, 120>;$$

Similarly, $$D32=<1, 120, 3, 60, 1, 120, 3, 60>;$$

$$D33=<\sqrt{3}, 30, 2, 60, 1, 90>;$$

$$D34=<2, 60, 1, 120, \sqrt{3}, 90, 1, 120, 1, 120>; \text{ and}$$

$$D35=D31.$$

Finally, configuration D4 is composed of two pieces D41 and D42 such that:

$$D41=D21; \text{ and}$$

$$D42=<3, 90, \sqrt{3}, 120, \sqrt{3}, 120, \sqrt{3}, 120, \sqrt{3}, 90>.$$

Figure 11:
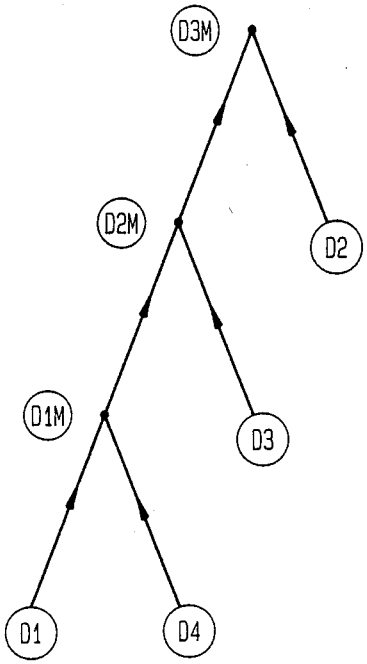
FIG. 11 depicts the manner in which the configurations from the hexagonal puzzle may be arranged to solve the puzzle.

The procedure for merging hexagonal configurations D1–D4 is shown by the "merging tree" diagram of FIG. 11. The depiction of this figure may be described in a manner substantially the same as that used to describe FIG. 8.

The color scheme for the hexagonal puzzle is: 401-yellow; 402-red; 403-black; and 404-green.

(5) Octagon Puzzle

With reference to FIG. 12, two of the four building block configurations, namely 501 and 502, for the octagon puzzle are depicted. Similarly, FIG. 13 shows the other two configurations, namely, configurations 503 and 504. Configuration 501 has side length of 2 units and is composed of four dissimilar pieceparts C11–E14.

$$E11=<2, 90, \sqrt{2}, 90, 2+\sqrt{2}, 45, 2, 135>;$$

$$E12=<2, 45, \sqrt{2}, 90, \sqrt{2}, 45>;$$

$$E13=<2, 90, 2, 45, 2\sqrt{2}, 45>; \text{ and}$$

$$E14=<2\sqrt{2}, 135, 2\sqrt{2}, 90, 2, 135, 2, 135, 2, 135, 2, 90>.$$

Configuration 502 is also comprised of four pieceparts. Two of them, represented by component E21, are identical and are equivalent to component E13 of configuration 501. Moreover, component E23 is equivalent to component E14 of configuration 501. The remaining component is shaped as follows:

$$E22=<2, 135, 2, 45, 2, 135, 2, 45>.$$

With respect to configuration 503, it also has three of its four constituent components identical to components from configuration 501. Thus, components E32, E33 and E34 are identical to components E12, E13 and E14, respectively. In addition, component E31 is as follows:

$$E31=<2, 135, 2-\sqrt{2}, 90, \sqrt{2}, 135, 2\sqrt{2}, 45, 2, 135>;$$

Finally, configuration 504 is shown as comprising four components E41–E44. Component E41 is identical to component E13; also, component E44 is identical to component E14. The two remaining components are described as follows:

$$E42=<2, 135, 2-\sqrt{2}, 90, \sqrt{2}, 90, 2, 45>; \text{ and}$$

$$E43=<\sqrt{2}, 135, 2, 45, 2\sqrt{2}, 90, \sqrt{2}, 90>.$$

Figure 14:
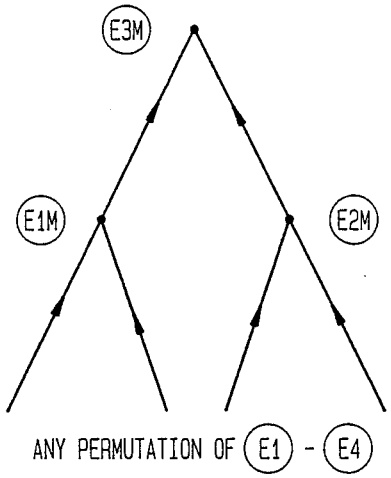
FIG. 14 depicts the manner in which the configurations from the octagonal puzzle may be arranged to solve the puzzle.

The technique for merging configurations 501–504 is set forth in FIG. 14. The octagon puzzle is unusual in that any permutation of configurations may be used at the start, that is, any two configurations may be chosen to arrive at merged configuration E1M. The remaining original configurations are then utilized to obtain merged configuration E2M. Merged configurations E1M and E2M are further merged to create merged configuration E3M.

The color assignment for the octagon puzzle is such that: 501-yellow, 502-red, 503-black and 504-green.

It should be generally mentioned that the solutions to the triangle puzzle and the square puzzle are based on designs of component parts that are less complex and even somewhat elementary relative to the other puzzle designs. The designs for the pentagon, hexagon and octagon puzzles, and their corresponding solutions, may be spoken of as being "difficult" whereas the triangle and square puzzles are "simple". The three difficult puzzles are mathematically more involved and therefore more challenging even to the sophisticated player. Moreover, it should be understood that the arrangements of the various pieceparts comprising each of the configurations are not necessarily unique. The disclosed arrangements are merely illustrative and are limited only by the scope of the claims.

(6) Game

The components of the game are composed of the five puzzles described in the foregoing sections, namely, the triangle puzzle with configurations A1–A4, the square puzzle with configurations B1–B4, the pentagon puzzle with configurations C1–C4, the hexagon puzzle with configurations D1–D4, and the octagon puzzle with configurations E1–E4. Since each puzzle includes four configurations, altogether there are twenty configurations for the game. Some of the configurations have multiple pieceparts (e.g., A3 has pieces A31 and A32). For purposes of the game, it is important to be able to distinguish groups of shapes (e.g., triangles A1–A4 from squares B1–B4 and so forth) for quick regrouping of configurations. This may be effected by having a distinguishing characteristic such as different thicknesses for the configurations (e.g., A1–A4 may be 0.7 inches thick and B1–B4 may be 0.8 inches thick, and so forth). It may also be possible to imprint or stamp a symbol on each piecepart (e.g., Δ for triangle pieces). Also, to distinguish pieceparts within a particular configuration shape, an identifier is utilized. Color coding is most practical, and this presumed in the following description according to the color scheme described in the foregoing discussion of the various puzzles.

A game is played by two to four players. Each player picks a color and then "controls" or "owns" the five configurations in that color at the commencement of a game. It is recommended that one of the players picks red and black is picked only when there are four players.

As before, a game is based upon the notion of a merger. Recall a merger is defined as the reassembling of the pieces of two configurations of the same shape (e.g. a triangle) into one merged configuration. A game is played in "rounds" of mergers. Each player attempts to perform a merger in every round.

A round starts with a roll of a special die to determine which players is the "starter" of a round. The die has one face for each of the four colors to identify the player who picked that color; the remaining two faces of the die are marked "same starter."

Beginning with the starter, the players one-by-one on a clockwise basis make their selections of pairs of configurations to be merged. Each player first selects a configuration that is under his/her control, and then selects for a merger attempt any other configuration of the same shape.

The pairs selected by each player must be comprised of the total pieces from the two separate configurations. A player passes a round either when he/she volunteers to do so or when there are no configurations to pair.

For example, consider the scenario when the configurations controlled by the players at the beginning of a round are as follows:

Starter of the round: A2, B2, C2, E3M
Next player: A1, B1M, C1M
Third player: A4, D4
Last player: A3, B3, C3, D2M Then the starter might select his/her own square B2 to be paired with the square B3 of the last player. Recall that this is a strategically "good" move since the two squares may be merged. The next player might select his/her own triangle A1 to be paired with the triangle A4 of the third player. This is not a good move since A4 and A1 are not mergeable into a merged configuration. The third player might select the hexagons D4 and D2M, and the last player might select the triangles A3 and A2.

When all selections are made, a timer is set and each player attempts to complete a merger in the time allowed. Whenever a player succeeds in a merger, the resulting merged configuration is now owned by that player. If a merger is unsuccessful, the two configurations used in the unsuccessful attempt revert to the respective players having control of the configurations prior to the unsuccessful attempt. A round is completed whenever all active players complete a merger or the timer expires. Making each four-color configuration, i.e., A3M, B3M, C3M, D3M or E3M scores one point. A game ends when no player makes a successful merger in, say, three consecutive rounds.

It is to be further understood that the compositions and methodologies described herein are not limited to specific forms by way of illustration, but may assume other embodiments limited only by the scope of the appended claims.

What is claimed is:

1. A puzzle comprising N initial configurations of identical geometric shape, with $N>3$, such that said shape is a regular polygon having equal length sides and equal vertex angles, and wherein said puzzle is solved by first assembling two of said initial configurations into a merged configuration having said shape to yield $(N-1)$ total number of remaining configurations, and then assembling two of said $(N-1)$ remaining configurations into another merged configuration having said shape to yield $(N-2)$ total number of configurations using an assembly method which is non-identical to the preceding assembly method, and continuing to assemble pairs from said configurations remaining after each merger using an assembly method which is non-identical to the immediately preceding assembly method, to obtain finally a single merged configuration having said shape and being composed of all of said initial configurations.

2. A puzzle comprising four initial configurations of identical geometric shape, and wherein said puzzle is solved by first assembling two of said initial configurations into a merged configuration having said shape to form three total number of configurations, and then assembling two of said three configurations into another merged configuration having said shape to form two total number of configurations, and finally assembling said two total number of configurations into a single merged configuration having said shape and being composed of all of said initial configurations, wherein said shape is an equilateral triangle, and said initial configurations include a first configuration having normalized side length of 6, a second configuration having a normalized side length of $2\sqrt{3}$, a third configuration having a normalized side length of 4, and a fourth configuration having a normalized side length of 6, wherein said first and second configurations are mergeable into a first merged equilateral triangle configuration, wherein said third configuration and first merged configuration are mergeable into a second merged equilateral triangle configuration, and wherein said fourth configuration and second merged configuration are mergeable into a third merged equilateral triangle configuration.

3. The puzzle as recited in claim 2 wherein said first configuration is a first equilateral triangle having sides of normalized length of 6, said first triangle being divided into three distinct pieces such that: said first piece is a right triangle having sides of normalized length of 3, $3\sqrt{3}$ and 6; said second piece is a right triangle of normalized length $\sqrt{3}$, 3 and $2\sqrt{3}$; and said third piece, being the remainder of said first equilateral triangle, is an isosceles triangle having sides of normalized length of $2\sqrt{3}$, $2\sqrt{3}$ and 6, said second configuration is a second equilateral triangle having sides of normalized length of $2\sqrt{3}$, said third configuration is a third equilateral triangle having sides of normalized length of 4, said third triangle being divided into two distinct pieces by bisecting one of the angles of said third triangle to form two right triangles each having sides of normalized length of 2, $2\sqrt{3}$ and 4, and said fourth configuration is a fourth equilateral triangle having sides of normalized length of 6, and wherein said first and second equilateral triangles are arrangeable into a first merged equilateral triangle having sides of normalized length of $4\sqrt{3}$, wherein said third equilateral triangle and said first merged triangle are arrangeable into a second merged equilateral triangle having sides of normalized length of 8, and wherein said fourth equilateral triangle and said second merged triangle are arrangeable into a third merged equilateral triangle having sides of normalized length of 10.

4. The puzzle as recited in claim 1 wherein N=4, said shape is a square, and said configurations include a first configuration having a normalized side length of 1, a second configuration having a normalized side length of $2\sqrt{2}$, a third configuration having a normalized side length of $2\sqrt{2}$, and a fourth configuration having a normalized side length of $2\sqrt{2}$, wherein said first and fourth configurations are mergeable into a first merged square configuration, wherein said second and third configurations are mergeable into a second merged square configuration, and wherein said first merged and said second merged configurations are mergeable into a third merged square configuration.

5. The puzzle as recited in claim 1 wherein N=4, said shape is a square, and such that said initial configurations include a first square having sides of normalized unit length, identically shaped second and third squares, each of said squares having sides of normalized length $2\sqrt{2}$, wherein each of said squares is divided into two distinct pieces by dividing along a diagonal to form two right triangles each having sides of normalized lengths of $2\sqrt{2}$, $2\sqrt{2}$ and 4, and a fourth square having sides of normalized length $2\sqrt{2}$, said fourth square being divided into three distinct pieces such that: said first piece is an isosceles triangle having sides of normalized lengths of 2, 2 and $2\sqrt{2}$; said second piece has the description $<\sqrt{2}, 90, 2\sqrt{2}, 45, 3, 90, 1, 135>$, and said third piece, being the remainder of said fourth square, has the description $<\sqrt{2}, 45, 1, 270, 1, 90, 2, 45, 2\sqrt{2}, 90>$, and wherein said first and fourth squares are arrangeable into a first merged square having sides of normalized length of 3, wherein said second and third squares are arrangeable into a second merged square having sides of normalized length of 4, wherein said first and second merged squares are arrangeable into a third merged square having sides of normalized length of 5.

6. The puzzle as recited in claim 1 wherein N=4, said shape is a pentagon, and said configurations include a first configuration having a normalized side length of $(10+2\sqrt{5})^{0.5}$, a second configuration having a normalized side length of $8(5-2\sqrt{5})^{0.5}$, a third configuration having a normalized side length of $2(10-2\sqrt{5})^{0.5}$, and a fourth configuration having a normalized side length of $3+\sqrt{5}$, and wherein said first and fourth configurations are mergeable into a first merged pentagonal configuration, wherein said third configuration and said first merged configuration are mergeable into a second pentagonal configuration, and wherein said second configuration and said second merged configuration are mergeable into a third merged pentagonal configuration.

7. The puzzle as recited in claim 1 wherein N=4, said shape is a pentagon, and such that said initial configurations include a first pentagon having sides of normalized length of $(10+2\sqrt{5})^{0.5}$, said first pentagon being divided into six distinct pieces such that: four of the pieces are identical isosceles triangles having two sides of length $1+\sqrt{5}$ and the third side equal to length of the side of said first pentagon; and two of the pieces are right triangles having a hypotenuse of $1+\sqrt{5}$ and legs of $0.5(3+\sqrt{5})$ and one-half the side of said first pentagon, a second pentagon having sides of normalized length of $8(5-2\sqrt{5})^{0.5}$, said second pentagon being divided into eight identical right triangles having a hypotenuse of $4\sqrt{5}-4$ and legs of 4 and one-half the side of said second pentagon, a third pentagon having sides of normalized length of $2(5-2\sqrt{5})^{0.5}$, said third pentagon being divided into six distinct pieces such that: four of the pieces are identical isosceles triangles having two sides equal to the length of the side of said third pentagon; and two of the pieces are right triangles having a hypotenuse of 4 and legs of $1+\sqrt{5}$ and one-half the side of said third pentagon, and a fourth pentagon having sides of normalized length of $3+\sqrt{5}$, said fourth pentagon being divided into six distinct pieces such that: two of the pieces are isosceles triangles having sides of $1+\sqrt{5}$, $1+\sqrt{5}$, and 2; one of the pieces is an isosceles triangle having sides of 4, 4 and $2+2\sqrt{5}$; one of the pieces is an isosceles triangle having sides of $1+\sqrt{5}$, $1+\sqrt{5}$ and $3+\sqrt{5}$; one of the pieces has the description $<3+\sqrt{5}, 108, 1+\sqrt{5}, 72, 4, 252, 4, 36, 4, 252, 3-\sqrt{5}, 72, 1+\sqrt{5}, 108>$; and the final piece has the description $<3-\sqrt{5}, 108, 4, 36, 1+\sqrt{5}, 108, 2, 108>$; and wherein said first and fourth configurations are mergeable into a first merged pentagonal configuration, wherein said third configuration and said first merged configuration are mergeable into a second merged pentagonal configuration, and wherein said second configuration and said second merged configuration are mergeable into a third merged pentagonal configuration.

8. The puzzle as recited in claim 1 wherein N=4, said shape is a hexagon, and said configuration include a first configuration having normalized side length of 3, a second configuration having normalized side length of 3, a third configuration having a normalized side length of 2, and a fourth configuration having a normalized side length of $\sqrt{3}$, and wherein said second and fourth configurations are mergeable into a first merged hexagonal configuration, wherein said third configuration and said first merged configuration are mergeable into a second merged hexagonal configuration, and wherein said first configuration and said second merged configuration are mergeable into a third merged hexagonal configuration.

9. The puzzle as recited in claim 1 wherein N=4, said shape is a hexagon, and said initial configurations include a first hexagon having sides of normalized length of 3, said first hexagon being divided into four distinct pieceparts D11–D14 described as follows:

D11=<3, 120, 2, 60, 5, 60, 2, 120>;

D12=<5, 120, 1, 60, 6, 60, 1, 120>;

D13=<6, 60, 2, 120, 4, 120, 2, 120>; and

D14=<4, 60, 1, 120, 3, 120, 1, 60>, a second hexagon having sides of normalized length of 3, said second hexagon being divided into two pairs of identical pieceparts, one of said pairs represented by D21 and the other of said pairs represented by D22 such that:

D21=<3, 30, $\sqrt{3}$, 120, $\sqrt{3}$, 30>; and

D22=<$\sqrt{3}$, 120, $2\sqrt{3}$, 120, $\sqrt{3}$, 90, 3, 120, 3, 90>;

a third hexagon having sides of normalized length of 2, said third hexagon being divided into five distinct pieceparts D31–D35 described as follows:

D31=<1, 60, 3, 60, 1, 120, 2, 120>;

D32=<1, 120, 3, 60, 1, 120, 3, 60>;

D33=<$\sqrt{3}$, 30, 2, 60, 1, 90>;

D34=<2, 60, 1, 120, $\sqrt{3}$, 90, 1, 120, 1, 120>; and

D35=D31, and a fourth hexagon having sides of normalized length of $\sqrt{3}$, said fourth hexagon being divided into two distinct pieceparts D41 and D42 such that:

D41=D21; and

D42=<3, 90, $\sqrt{3}$, 120, $\sqrt{3}$, 120, $\sqrt{3}$, 120, $\sqrt{3}$, 120>, and wherein said second and fourth configurations are mergeable into a first merged hexogonal configuration, wherein said third configuration and said first merged configuration are mergeable into a second merged hexagonal configuration, and wherein said first configuration and said second merged configuration are mergeable into a third merged hexagonal configuration.

10. The puzzle as recited in claim 1 wherein N=4, said shape is an octagon, and said configurations included a first configuration having normalized side length of 2, a second configuration having normalized side length of 2, a third configuration having normalized side length of 2, and a fourth configuration having normalized side length of 2, and wherein any two of said four configurations are mergeable into a first merged octagonal configuration, wherein the other two remaining original configurations are mergeable into a second merged octagonal configuration, and wherein said first merged and said second merged configurations are mergeable into a third merged octagonal configuration.

11. The puzzle as recited in claim 1 wherein N=4, said shape is an octagon, and said initial configurations include a first octagon having sides of normalized length of 2, said first octagon being divided into four distinct pieceparts E11–E14 described as follows:

E11=<2, 90, $\sqrt{2}$, 90, $2\sqrt{2}$, 45, 2, 135>;

E12=<2, 45, $\sqrt{2}$, 90, $\sqrt{2}$, 45>;

E13=<2, 90, 2, 45, $2\sqrt{2}$, 45>; and

E14=<$2\sqrt{2}$, 135, $2\sqrt{2}$, 45, 2, 135, 2, 135, 2, 135, 2, 90>, a second octagon having sides of normalized length of 2, said second octagon being divided into four distinct pieceparts such that two of the pieceparts are identical and are represented by E21 and the other two pieceparts are represented by E22 and E23 described as follows:

E21 is equivalent to E13;

E22=<2, 135, 2, 45, 2, 135, 2, 45>; and

E23 is equivalent to E14, a third octagon having sides of normalized length of 2, said third octagon being divided into four distinct pieceparts E31–E34 described as follows:

E31=<2, 135, $2-\sqrt{2}$, 90, $\sqrt{2}$, 135, $2\sqrt{2}$, 45, 2, 135>;

E32 is equivalent to E12;

E33 is equivalent to E13; and

E34 is equivalent to E14, a fourth octagon having sides of normalized length of 2, said fourth octagon being divided into four distinct pieceparts E41–E44 described as follows:

E41 is equivalent to E13;

E42=<2, 135, $2-\sqrt{2}$, 90, $\sqrt{2}$, 90, 2, 45>;

E43=<$\sqrt{2}$, 135, 2, 45, $2\sqrt{2}$, 90, $\sqrt{2}$, 90>; and

E44 is equivalent to E14, and wherein any two of said initial configurations are mergeable into a first merged octagonal configuration, wherein the remaining two of said initial configurations are mergeable into a second merged octagonal configuration, and wherein said first merged configuration and said second merged configuration are mergeable into a third merged octagonal configuration.

* * * * *